US010238209B2

(12) United States Patent
Ahmedov et al.

(10) Patent No.: US 10,238,209 B2
(45) Date of Patent: Mar. 26, 2019

(54) HOME APPLIANCE DEVICE WITH A DOOR RACK CONTAINER AND HOME APPLIANCE INCLUDING THE HOME APPLIANCE DEVICE

(71) Applicant: BSH HAUSGERAETE GMBH, Munich (DE)

(72) Inventors: Sezgin Ahmedov, Regensburg (DE); Altan Alyanak, Instanbul (TR); Dogukan Cetinyol, Istanbul (TR); Fidan Gueler, Istanbul (TR); Aydin Kutlu, Istanbul (TR); Muratcan Malkoc, Tekirdag (TR); Laura Ringemann Springer, Hohenbrunn (DE); Graham Sadtler, Huntington Beach, CA (US); Gonca Subasi, Istanbul (TR); Rasit Oenver, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/632,597

(22) Filed: Jun. 26, 2017

(65) Prior Publication Data

US 2017/0367478 A1 Dec. 28, 2017

(30) Foreign Application Priority Data

Jun. 27, 2016 (TR) ..... a 2016/08856

(51) Int. Cl.
*F25D 23/04* (2006.01)
*A47B 57/58* (2006.01)
(Continued)

(52) U.S. Cl.
CPC ..... *A47B 57/58* (2013.01); *A47B 96/04* (2013.01); *F25D 23/04* (2013.01); *F25D 25/025* (2013.01);
(Continued)

(58) Field of Classification Search
CPC ..... A47B 57/58; A47B 96/04; F25D 23/04; F25D 25/025
(Continued)

(56) References Cited

U.S. PATENT DOCUMENTS 379,166 A * 3/1888 Hunter
447,532 A * 3/1891 Bacon
(Continued)

FOREIGN PATENT DOCUMENTS

EP 1724539 A2 11/2006

*Primary Examiner* — James O Hansen
(74) *Attorney, Agent, or Firm* — Laurence A. Greenberg; Werner H. Stemer; Ralph E. Locher

(57) ABSTRACT

A home appliance device, in particular a home appliance chiller device, with improved efficiency, includes a door rack container having an access opening and a pivot unit which is pivotably coupled to the door rack container about a pivot axis. The pivot unit includes a container door for closing the access opening and a receptacle coupled to the container door for storing products. The receptacle includes an extension which is at least substantially parallel to a main extension plane of the access opening and at least substantially perpendicular to the pivot axis. The extension of the receptacle is at least 5% shorter than a corresponding extension of the container door in a closed state of the container door. A home appliance, in particular a home chiller appliance, including a home appliance device, is also provided.

18 Claims, 6 Drawing Sheets

(51) Int. Cl.

| | |
|---|---|
| ***A47B 96/04*** | (2006.01) |
| ***F25D 25/02*** | (2006.01) |
| *A47B 96/00* | (2006.01) |
| *F25D 23/00* | (2006.01) |

(52) U.S. Cl.
CPC ..... *A47B 96/00* (2013.01); *F25D 23/00* (2013.01); *F25D 2500/02* (2013.01)

(58) Field of Classification Search
USPC .... 312/270.2, 212, 319.4, 405, 405.1, 321.5
See application file for complete search history.

(56) References Cited

U.S. PATENT DOCUMENTS

| | | | | |
|---|---|---|---|---|
| 4,186,978 | A * | 2/1980 | Thomson | F25D 23/04 211/80 |
| 4,719,764 | A * | 1/1988 | Cook | F25D 11/00 297/180.14 |
| 5,323,939 | A * | 6/1994 | Young | B65D 90/582 222/463 |
| 7,472,974 | B2 | 1/2009 | Czach et al. | |
| 8,864,252 | B1 * | 10/2014 | Rodriguez Cobas | F25D 23/04 312/321.5 |
| 2004/0012314 | A1 * | 1/2004 | Hay | A47B 46/005 312/405.1 |
| 2005/0116596 | A1 * | 6/2005 | Leimkuehler | F25D 23/04 312/405.1 |
| 2007/0113578 | A1 * | 5/2007 | Wu | F25C 5/182 62/344 |
| 2014/0360220 | A1 * | 12/2014 | Rackley | F25D 23/028 62/377 |

* cited by examiner

HOME APPLIANCE DEVICE WITH A DOOR RACK CONTAINER AND HOME APPLIANCE INCLUDING THE HOME APPLIANCE DEVICE

CROSS-REFERENCE TO RELATED APPLICATION

This application claims the priority, under 35 U.S.C. § 119, of Turkish Patent Application TR 2016/08856, filed Jun. 27, 2016; the prior application is herewith incorporated by reference in its entirety.

BACKGROUND OF THE INVENTION

Field of the Invention

The invention relates to a home appliance device, in particular a home appliance chiller device, having a door rack container. The invention also relates to a home appliance, in particular a home chiller appliance, including a home appliance device.

European Patent Application EP 1 724 539 A2, corresponding to U.S. Pat. No. 7,472,974, discloses a home appliance device which includes a door rack container and a pivot unit pivotably coupled to the door rack container about a pivot axis.

SUMMARY OF THE INVENTION

It is accordingly an object of the invention to provide a home appliance device with a door rack container and a home appliance including the home appliance device, which overcome the hereinafore-mentioned disadvantages of the heretofore-known devices and appliances of this general type and which have improved characteristics regarding efficiency.

With the foregoing and other objects in view there is provided, in accordance with the invention, a home appliance device, in particular a home appliance chiller device, comprising a door rack container having an access opening and a pivot unit being pivotably coupled to the door rack container about a pivot axis and including a container door for closing off the access opening as well as a receptacle coupled to the container door for storing products. The receptacle has an extension, in particular a main extension, which is at least substantially parallel to a main extension plane of the access opening and at least substantially perpendicular to the pivot axis and which is at least 5%, preferably at least 15% and advantageously at least 25% shorter than a corresponding extension, in particular a main extension, of the container door. The corresponding extension is in particular at least substantially parallel to the extension of the receptacle, in a closed state of the container door.

Through the use of the invention in particular efficiency, especially assembly efficiency, an efficiency of components and a cost efficiency of the home appliance device can be improved. In particular, due to the above-mentioned implementation of the pivot unit a usability of the home appliance device can be improved.

In this context, "configured" is in particular to mean specifically constructed and/or equipped. An object being configured for a certain function is in particular to be understood to mean that the object implements and/or fulfills that certain function in at least one application state and/or operating state. A "home appliance device" is in particular to be understood to mean at least a portion, preferably a sub-assembly group, of a home appliance. The home appliance is in particular provided for storing, preserving and/or adjusting the temperature of temperature-sensitive, humidity-sensitive and/or photosensitive products in at least one operating state, advantageously for the purpose of enhancing a keepability of the stored products. In this context, "products" are in particular to be understood as temperature-sensitive, humidity-sensitive and/or in particular photosensitive products, such as medicines and/or victuals, e.g. beverages, meat, fish, vegetables, fruits, milk and/or dairy products. Advantageously, the home appliance is embodied as a home chiller appliance, which is configured for cooling products in at least one operating state. The home chiller appliance could in particular be embodied as a climate cabinet, an ice-box, a refrigerator, a freezer, a refrigerator-freezer combination and/or a wine cooler. However, the home appliance could also be embodied as a home appliance for warming up and in particular for cooking goods, e.g. an oven, a cooking hob or cooktop, a steamer and/or a microwave. The home appliance device may further include a home appliance door and in particular a housing, wherein the home appliance door is configured for closing the housing.

In this context, "a door rack container" is in particular to be understood as a container, which is configured to be coupled, preferably releasably coupled, to a home appliance door, in particular to an inner side of the home appliance door, which preferably faces the housing. In this context, the term "coupled" is in particular to mean at least indirectly and preferably directly connected, attached and/or fixed and advantageously operatively connected, attached and/or fixed. "Coupled" may in particular mean connected in a form-locking and/or a force-locking manner and advantageously implemented integrally or in one piece. The term "connected in a force-locking and/or form-locking manner" or "connected in at least one of a force-locking or form-locking manner" is in particular to be understood to mean connected, preferably releasably connected, wherein a holding force between two structural components is preferably transferred through a geometric engagement of the structural components with each other, and/or through a friction force acting preferably between the structural components. "Implemented integrally" is in particular to mean, in this context, connected at least by substance-to-substance bonding, e.g. by a welding process, an adhesive bonding, an injection-molding process and/or by another process that is deemed expedient by a person having ordinary skill in the art. Advantageously, "implemented integrally" could in particular mean made of one piece. "Made of one piece" is in particular to mean, in this context, manufactured from one single piece, e.g. by production from one single cast and/or by manufacturing in a one-component or multi-component injection-molding process, and advantageously from a single blank. Preferably a main extension plane of the door rack container is at least substantially parallel to a main extension plane of the home appliance door. A "main extension plane" of an object is, in particular, to be understood as a plane extending parallel to a largest side of an imaginary rectangular cuboid which only just entirely encloses the object and preferably extends through a geometric center of the object. In this context, "at least substantially parallel" is in particular to be understood as an orientation of a direction with respect to a reference direction, in particular in a plane, wherein the direction has a deviation from the reference direction in particular of less than 15°, advantageously of less than 10° and particularly advantageously of less than 2°.

The door rack container includes in particular a receiving space. The receiving space is in particular configured for at least partly receiving the pivot unit preferably at least in a closed state of the container door. Advantageously the receiving space is configured for receiving the receptacle of the pivot unit at least partly, preferably at least mostly and advantageously entirely. The term "at least mostly" with reference to an object is in particular to mean by more than 50%, preferably more than 70%, and advantageously more than 90% of a volume, in particular an enclosed volume, surface and/or mass of the object. The door rack container includes in particular at least three, preferably at least four and advantageously at least five, in particular exactly five walls, namely preferably a top wall, a bottom wall, a back wall and two lateral walls, which delimit the receiving space. Preferably at least the top wall, the back wall and at least one of the lateral walls are disposed at least substantially perpendicular to one another. The term "at least substantially perpendicular" is in particular intended to define, in this context, an orientation of a direction with respect to a reference direction, wherein the direction and the reference direction, in particular if viewed in one plane, enclose an angle between 80° and 100°, in particular between 85° and 95°, preferably between 88° and 92° and particularly advantageously an angle of 90°. The door rack container includes in particular a frame which connects the lateral walls and the back wall to the top wall. In particular a main extension plane of at least one wall, preferably of exactly one wall, advantageously of the back wall of the door rack container is at least substantially parallel to a main extension plane of the home appliance door. The receiving space of the door rack container is in particular accessible by using the access opening. In particular a main extension plane of the access opening is at least substantially parallel to the main extension of the home appliance door.

In this context, "a pivot unit" is in particular understood as a unit which is at least pivotable around at least one pivot axis and which may preferably also be configured for a translational movement in at least one spatial direction, preferably at least two, advantageously at least substantially perpendicular spatial directions, which are in particular perpendicular to one another. Preferably the container door and the receptacle of the pivot unit are coupled in such a way that a movement of either one of the receptacle and the container door results in a movement of both the container door and the receptacle. The pivot unit is in particular at least partly implemented integrally. Preferably the container door and the receptacle are connected to each other integrally. Alternatively or additionally the receptacle and the container door may in particular be coupled in a form-locking-and/or force-locking manner.

The receptacle includes a storage space for storage of products. The receptacle includes a storage opening for storing products inside the storage space. In a closed state of the container door, a main extension plane of the storage opening is oriented in particular at least substantially perpendicular to the access opening of the door rack container and/or to a main extension plane of the home appliance door. The receptacle includes at least three, preferably at least four and advantageously at least five walls, in particular exactly five walls delimiting the storage space, namely preferably a bottom wall, a back wall, a front wall and two lateral walls. Preferably at least the bottom wall, the back wall and at least one of the lateral walls are disposed at least substantially perpendicular to one another. In particular the receptacle is coupled to the container door through the front wall. Preferably the front wall is implemented integrally with the container door. The extension of the receptacle, which is shorter than the corresponding extension of the container door in a closed state of the container door by at least 5%, preferably at least 15% and advantageously at least 25%, is the extension of the back wall of the receptacle.

The door rack container and/or the pivot unit, preferably the receptacle and/or the container door, are in particular at least partly, preferably at least mostly and advantageously entirely at least substantially translucent and advantageously at least substantially transparent. Preferably the door rack container and/or the pivot unit, preferably the receptacle and/or the container door, are in particular at least partly, preferably at least mostly and advantageously entirely made of an at least substantially translucent and preferably at least substantially transparent material deemed advantageous by someone skilled in the art, in particular plastic, preferably such as an acrylic glass, poly (methyl methacrylate), polycarbonate and/or polystyrene. In this context, "at least substantially translucent" is in particular to mean at least partly translucent for visible light, namely in particular for at least 10%, preferably for at least 30% and advantageously for at least 50% of incoming light, wherein the incoming light is diffusely scattered. In this context, "at least substantially transparent" is in particular to mean at least partly translucent for visible light, namely in particular for at least 10%, preferably for at least 30% and advantageously for at least 50% of incoming light, wherein an orientation of exiting light is at least substantially parallel to the incoming light. It is conceivable that, in particular for preserving photosensitive goods, the door rack container and/or the pivot unit, preferably the receptacle and/or the container door, may in particular be at least partly, preferably at least mostly and advantageously entirely lightproof, in particular at least substantially opaque, and are in particular at least partly, preferably at least mostly and advantageously entirely made of an at least substantially opaque material deemed advantageous by someone skilled in the art, such as plastic and/or metal. In this context, "at least substantially opaque" is in particular to be understood as meaning at least partly opaque for visible light, namely in particular for at least 50%, preferably for at least 70% and advantageously for at least 90% of incoming light. In particular the door rack container, in particular the top wall, the back wall, the bottom wall and the lateral walls, is at least mostly made of an at least substantially translucent plastic. Preferably at least the frame of the door rack container is made of metal.

Further, it is proposed that the pivot axis be horizontally disposed in an installation position. The pivot axis is oriented in particular at least substantially parallel to a horizontal plane. In this context, a "horizontal plane" is in particular to be understood as a main extension plane of a base on which the home appliance device is installed in an installation position. The pivot axis is in particular disposed at least substantially parallel to a main extension plane of the home appliance door and preferably at least substantially perpendicular to a main extension direction of the home appliance door and/or of the door rack container. As a result, an easy access to the pivot unit can be achieved.

Advantageously the pivot axis is disposed at a lower portion of the door rack container, in particular in a vicinity of the bottom wall of the door rack container. In this context, a "vicinity" is in particular to be understood as a spatial region around a reference object, including coordinates which have a distance from the reference object of at most 200 mm, preferably at most 100 mm and advantageously at most 50 mm. In particular, this allows simplifying an assembly and a disassembly.

For the purpose of achieving an advantageous space-saving configuration of the pivot unit inside of the door rack container, it is proposed that the pivot unit has an at least substantially L-shaped contour when viewed in a direction of the pivot axis. In this context, an at "least substantially L-shaped object" is in particular to be understood as an object which includes a volume and/or area which preferably deviates by at most 20% from a volume and/or area of a L-shaped reference object. In this context, a "contour" is in particular understood as at least a partial section of an outline of a 2-dimensional projection of the pivot unit along the pivot axis.

In a preferred implementation of the invention it is proposed that the container door has a door section which is at least substantially flush with an upper portion of the door rack container and which forms a handle. In this context, the term "at least substantially flush" is in particular to be understood to mean that, viewed in at least one direction, at least two objects overlap and form a joint edge. In particular, when viewed in a direction at least substantially perpendicular to a main extension plane of the access opening, the door section and the upper portion of the door rack container overlap with each other. The upper portion of the door rack container is in particular defined by the frame and/or the top wall of the door rack container. The handle includes an at least substantially triangle-shaped cross-section. In this context, an "at least substantially triangle-shaped object" is in particular to be understood as an object which includes a volume and/or area which preferably deviates by at most 20% from a volume and/or area of a triangle-shaped reference object. Preferably the door section, in particular the handle is made of a different material than a base body of the container door. Advantageously, the door section, in particular the handle, is in particular made of the same material as the frame and preferably of metal, in particular aluminum. As a result, in particular the container door can be easily operated by using the handle. Advantageously, a uniform construction of the door rack container and the pivot unit can be achieved.

In particular, in order to upgrade a product-storage quality and preferably to reduce an installation space, it is proposed that the receptacle is disposed at least mostly and preferably entirely inside the door rack container in the closed state of the container door. The term "at least mostly" with reference to an object is in particular to mean by more than 50%, preferably by more than 70%, and advantageously by more than 90% of a volume, in particular an enclosed volume, and/or of a mass of the object. In particular, the receptacle is at least mostly and preferably entirely delimited from at least three sides, preferably at least four sides and advantageously at least five sides, in particular exactly five sides, preferably by the walls of the receptacle.

In addition it is proposed that the home appliance device further includes a bearing unit, which is configured for pivotably coupling the pivot unit to the door rack container and which includes a first bearing element coupled to the pivot unit and a second bearing element coupled to the door rack container, wherein the first bearing element and the second bearing element are detachable from each other by moving the container door with respect to the door rack container in a direction at least substantially parallel to the main extension plane of the access opening and in particular by moving, preferably consecutively moving, the container door with respect to the door rack container in a direction at least substantially perpendicular to the main extension plane of the access opening. The bearing unit is in particular at least partly implemented integrally with the door rack container and/or the container door. The first bearing element is in particular implemented integrally with the container door. The second bearing element is in particular implemented integrally with the door rack container. The first bearing element is in particular implemented as a rod or pin and the second bearing element is in particular implemented as a slotted link, or vice versa. The second bearing element is in particular configured for guiding the first bearing element at least substantially parallel to the main extension plane of the access opening and consecutively at least substantially perpendicular to the main extension plane of the access opening. The second bearing element includes in particular a guiding recess for guiding the first bearing element. The first bearing element engages in particular into the second bearing element and can in particularly be pulled out of the second bearing element in a direction at least substantially perpendicular to the main extension plane of the access opening. As a result of this, in particular, this allows detaching the pivot unit from the door rack container. In particular, accidental detaching by a pivot movement of the pivot unit can be prevented. Advantageously, the pivot unit, the coupling unit and the door rack container can be cleaned separately.

It is further proposed that the home appliance device includes a closure unit, which is configured for supporting a closing operation of the pivot unit and/or for securing the pivot unit in a closed state. The closure unit is in particular configured for reducing a force required for the closing operation of the pivot unit and for increasing a force required for an opening operation of the pivot unit. As a result of this, in particular an operative safety can be increased since unintended opening of the pivot unit due to pressure equalization when opening the home appliance door can be preferably prevented. Furthermore, usability can be improved since the closure unit supports a closing process.

In order to reinforce a pivot movement of the pivot unit, it is proposed that the closure unit includes a counterweight which is coupled to the receptacle, in particular to a back wall of the receptacle, for adjusting a center of mass of the pivot unit with respect to the pivot axis. The counterweight is in particular coupled to the receptacle in a form-locking and/or force-locking manner, preferably by using a tongue-and-groove connection, a bolt connection and/or a screw connection. Alternatively or additionally, the counterweight and/or the receptacle may be connected through substance-to-substance bonding, preferably by an adhesive bond. Advantageously the counterweight is disposed opposite the container door. The counterweight is in particular at least partly, preferably at least mostly disposed inside the storage space of the receptacle. A main extension plane of the counterweight is at least substantially parallel to the main extension plane of the container door. The weight of the counterweight amounts to at least 40%, preferably at least 60%, further preferably at least 80% and advantageously at least 100% of the weight of the pivot unit. The counterweight is in particular at least partly made of metal, such as zinc, aluminum, magnesium and/or copper and/or preferably of a metal alloy, in particular of those metals, advantageously Zamak.

In addition, it is proposed that the closing unit includes a first closing element connected to the door rack container, preferably to the top wall and/or the frame of the door rack container, and includes a corresponding second closing element connected to the container door, preferably the door section, which closing elements interact with one another for supporting a closing operation of the container door and/or for securing the container door in a closed state. The closing elements are in particular coupled to the door rack container and/or to the container door in a form-locking and/or force-locking manner. Alternatively or additionally, the counterweight and/or the receptacle may be connected through substance-to-substance bonding, preferably by an adhesive bond. The first closing element is in particular connected by placing it inside a cavity of the door rack container, in particular the frame. The second closing element is in particular connected to the container door, in particular the door section by a screw-connection, wherein preferably the second closing element itself is embodied as a screw. The first and second closing elements are always spaced apart from each other and preferably do not touch, regardless of an operating state. Advantageously the first closing element and the second closing element are at least partly made of a magnetic material, preferably a ferromagnetic material, e.g. iron, nickel and/or cobalt and/or preferably of a ferromagnetic metal alloy, in particular of those metals. As a result of this, in particular closing and securing of the container door can be further improved in a simple manner.

It is also proposed that the home appliance device further includes a damping unit for damping a pivot movement of the pivot unit during an opening and/or closing operation of the container door. It is further proposed that the damping unit includes at least one damping element for damping a pivot movement of the container door during the closing operation of the container door. The damping element is in particular coupled to the door rack container, in particular to the lateral wall of the door rack container. A main extension of the damping element is in particular at least substantially perpendicular to a main extension of the container door in the closed state of the container door. In particular, during a closing operation and in the closed state of the container door, the damping element applies a force onto the container door. The damping element is preferably deformable and is advantageously embodied as piston. "Deformable" is in particular intended to mean repeatedly, preferably reversibly, further preferably elastically, advantageously viscoelastically and/or especially advantageously hyperelastically deformable. In particular, a deformable object, is preferably implemented of an elastic material and preferably has an elastic modulus of at most 10 GPa, preferably at most 1 GPa and advantageously at most 0.1 GPa. A deformable object is preferably deformable by at least 1 mm, preferably at least 2 mm and advantageously at least 5 mm in at least one direction. In addition, it is proposed that the damping unit includes a further damping element for damping a pivot movement of the receptacle during the opening operation of the container door. The further damping element is in particular coupled to the top wall and/or the frame of the door rack container. The damping element is preferably deformable and is advantageously embodied as a silicone plug. The receptacle, in particular the back wall of the receptacle and/or the counterweight, is implemented as a stopper element which strikes onto the further damping element during the opening operation of the container door. As a result of this, in particular the closing and/or opening operation can be improved. Advantageously the damping unit prevents components from being damaged and allows for soft and silent closing or opening.

In an advantageous implementation of the invention it is proposed that the pivot unit is at least partly, preferably at least mostly and advantageously entirely at least substantially translucent. As a result, in particular a visibility of items placed inside of the pivot unit can be improved.

It is also proposed that the door rack container includes a guiding element for centering the container door with respect to the access opening. The guiding element is in particular implemented as a ledge. The guiding element is in particular disposed on the front side of the door rack container facing the container door. The guiding element is in particular implemented integrally with at least one wall, preferably at least one of the lateral walls of the door rack container. In particular, a main extension of the guiding element runs at least substantially parallel to the main extension plane of the access opening. The home appliance door includes in particular a corresponding guiding element. In particular, in a closed state of the container door, the guiding element and the corresponding guiding element adjust to each other and preferably close the door rack container preferably airtightly. As a result, the container door can be guided centrally in a simple manner, advantageously airtightly.

Further it is proposed that the home appliance device includes a coupling unit, which is configured for coupling the door rack container to a home appliance door and which includes an at least partly deformable coupling element supporting the door rack container with respect to the home appliance door. The coupling element is in particular at least partly implemented integrally with the door rack container. The coupling element includes in particular a corbel, which is preferably implemented as a protrusion of the door rack container, in particular of the back wall of the door rack container. The coupling element includes a deformable element. The deformable element is implemented as a silicone plug. The coupling unit includes in particular a mounting element. The mounting element is connected to the door rack container, in particular to the frame and/or the back wall. Alternatively and/or additionally, the mounting element may be implemented integrally with the door rack container, in particular the frame and/or the back wall. The mounting element is advantageously implemented as a hook. The coupling unit includes in particular a corresponding mounting element, which is preferably connected to the home appliance door. Alternatively or additionally, the corresponding mounting element may be implemented integrally with the home appliance door. The mounting element and the corresponding mounting element create a form-locking connection between the home appliance door and the door rack container. As a result, in particular a movement and/or vibrations of the receptacle during closing and opening can be reduced. Advantageously, a risk of the home appliance device being damaged by a movement of the receptacle with respect to the home appliance door can be reduced.

The home appliance device described herein is not to be limited to the application and implementation described above. In particular, for the purpose of fulfilling a functionality described herein, the home appliance device may include a number of respective elements, structural components and units that differs from the number mentioned herein. Furthermore, regarding the value ranges mentioned in this disclosure, values within the limits mentioned are to be understood to be also disclosed and to be used as applicable.

Other features which are considered as characteristic for the invention are set forth in the appended claims.

Although the invention is illustrated and described herein as embodied in a home appliance device with a door rack container and a home appliance including the home appliance device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Further advantages may become apparent from the following description of the drawings. In the drawings, an exemplary embodiment of the invention is shown. The drawings, the description and the claims contain a plurality of features in combination. The person having ordinary skill in the art will purposefully also consider the features separately and will find further expedient combinations.

DETAILED DESCRIPTION OF THE INVENTION

Figure 1:
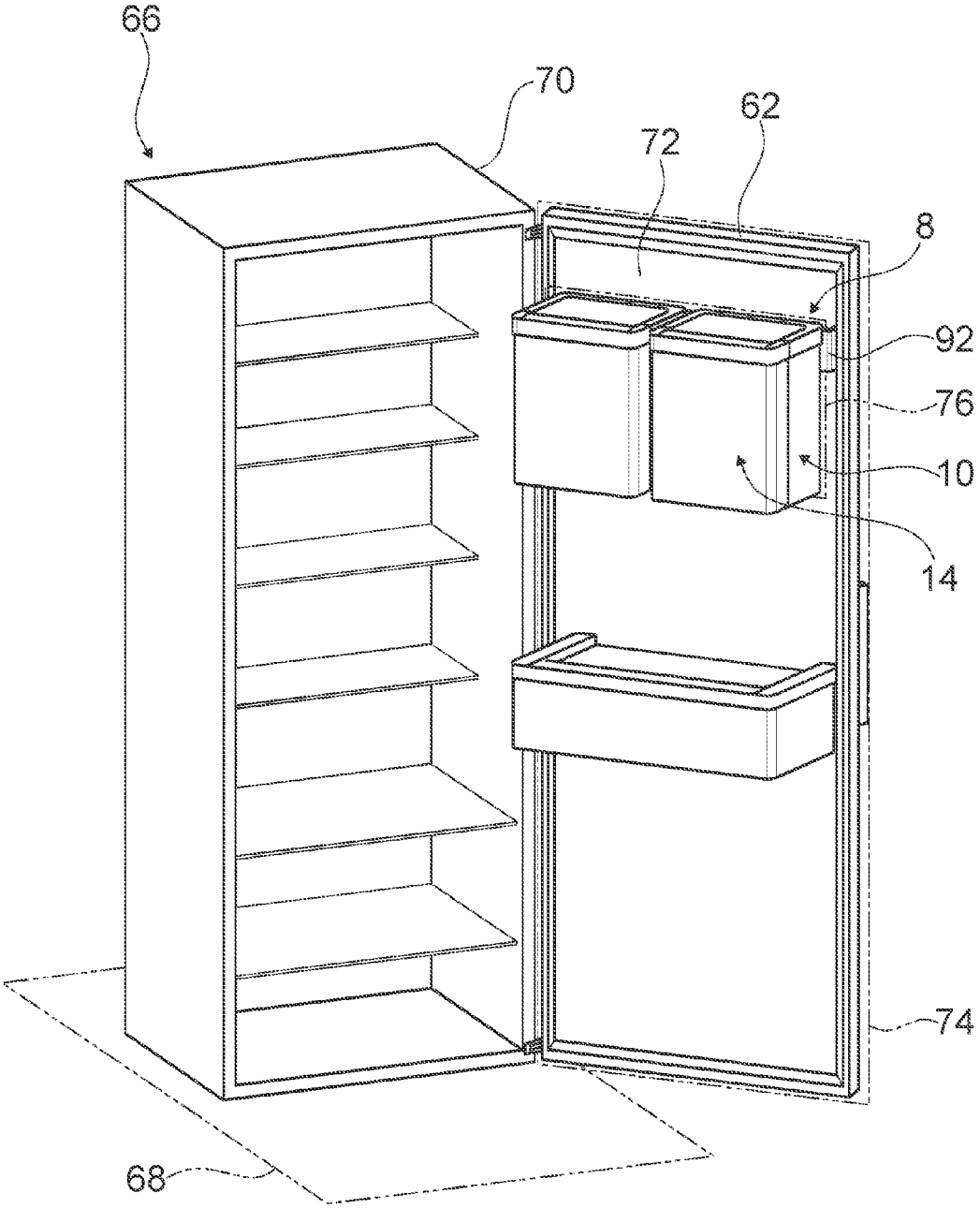
FIG. 1 is a diagrammatic, perspective view of a home appliance including a home appliance device.

Referring now to the figures of the drawings in detail and first, particularly, to FIG. 1 thereof, there is seen a perspective view of a home appliance 66 which includes a home appliance device. The home appliance 66 is embodied as a refrigerator. The home appliance 66 could also be embodied as a freezer, a refrigerator-freezer combination, a climate cabinet, an ice-box and/or a wine cooler. In FIG. 1 the home appliance device is shown in an installation position. The home appliance device is installed on a base. The base defines a horizontal plane 68. The home appliance device includes a housing 70. The housing 70 is installed upright on the base. The home appliance device includes a home appliance door 62. The home appliance door 62 is configured for closing the housing 70 in at least one operation state. The home appliance door 62 includes an inner surface 72. The inner surface 72 of the home appliance door 62 faces an inside of the housing 70 in a closed state of the home appliance door 62. In FIG. 1 the home appliance device is shown in an opened state of the home appliance door 62.

The home appliance device includes at least one door rack bin 8. The door rack bin is disposed at the home appliance door 62. In the present case the home appliance device includes two door rack bins 8. The door rack bins 8 are positioned side-by side. Alternatively or additionally the door rack bins 8 may be positioned one below the other. It is conceivable that the home appliance device may include a deviating number of door rack bins 8 as deemed advantageous by someone skilled in the art. Further, in the present case the door rack bins 8 are embodied at least substantially identical. It is conceivable that the home appliance device preferably includes a combination of different embodiments of door rack bins 8. For the sake of clarity, in the following only one door rack bin 8 is given a reference numeral and is described in detail. The following description may be transferred to further door rack bins accordingly.

Figure 2B:
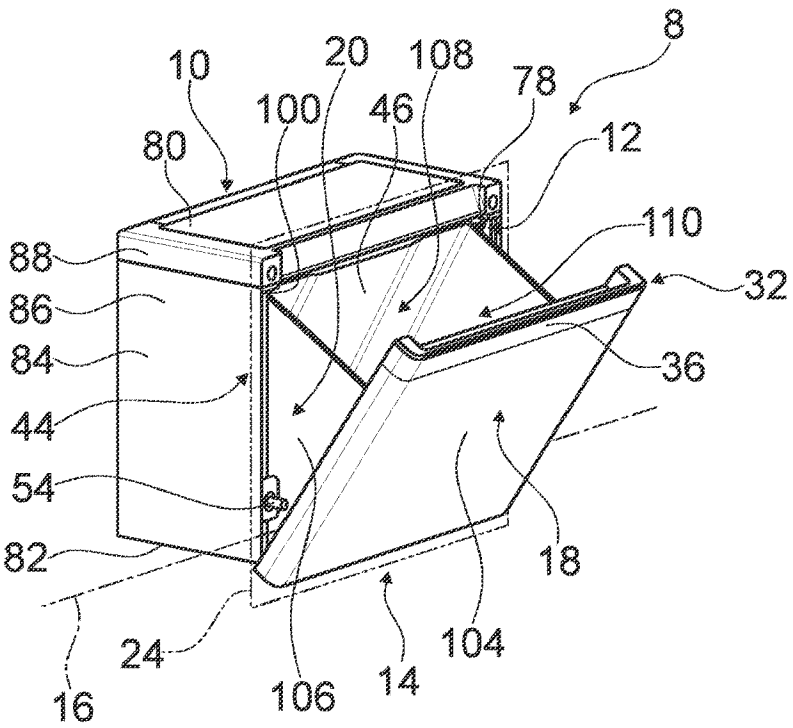
FIGS. 2A and 2B are perspective views showing a portion of the home appliance device, including a door rack bin in an opened state and a closed state.
Figure 2A:
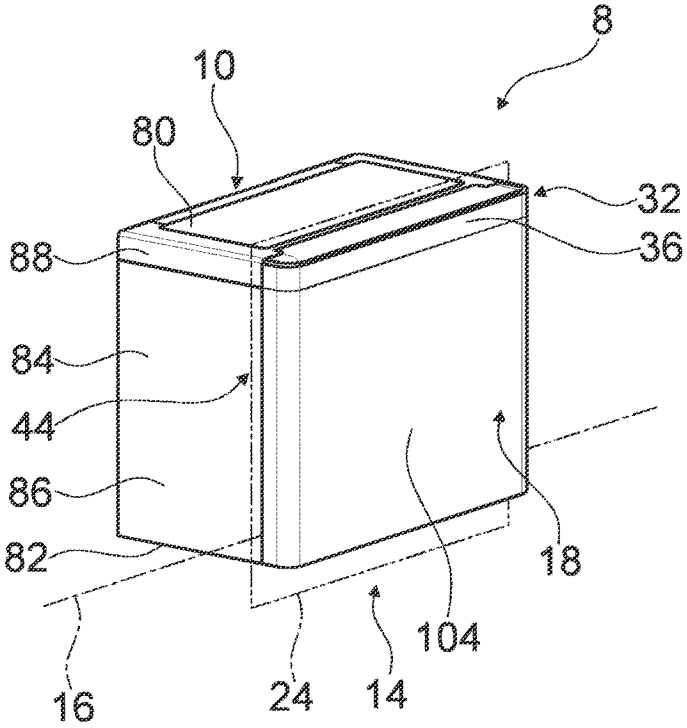
Figure 3B:
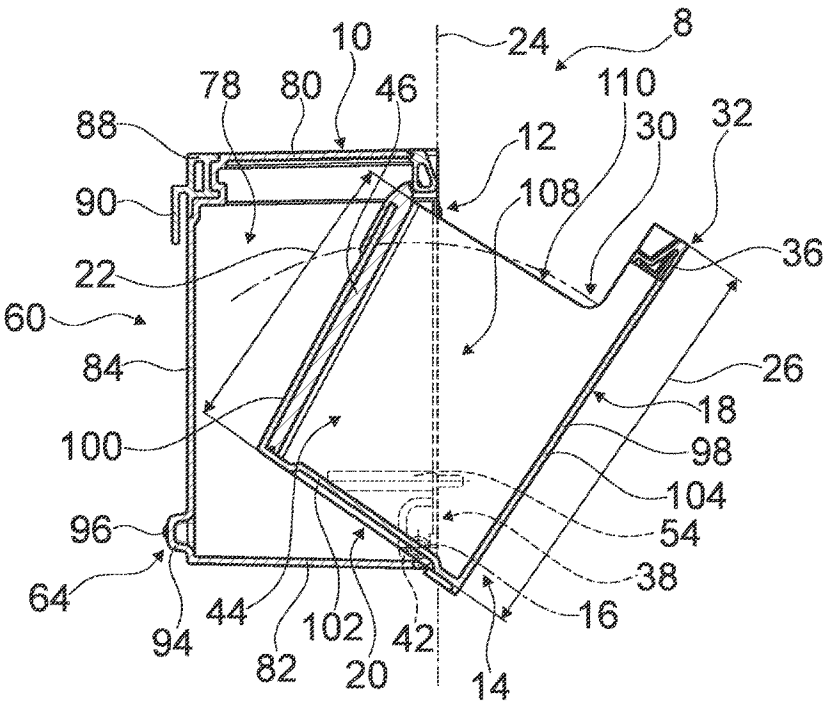
FIGS. 3A-3B are cross-sectional views showing a portion of the home appliance device, including the door rack bin in an opened state and a closed state.
Figure 3A:
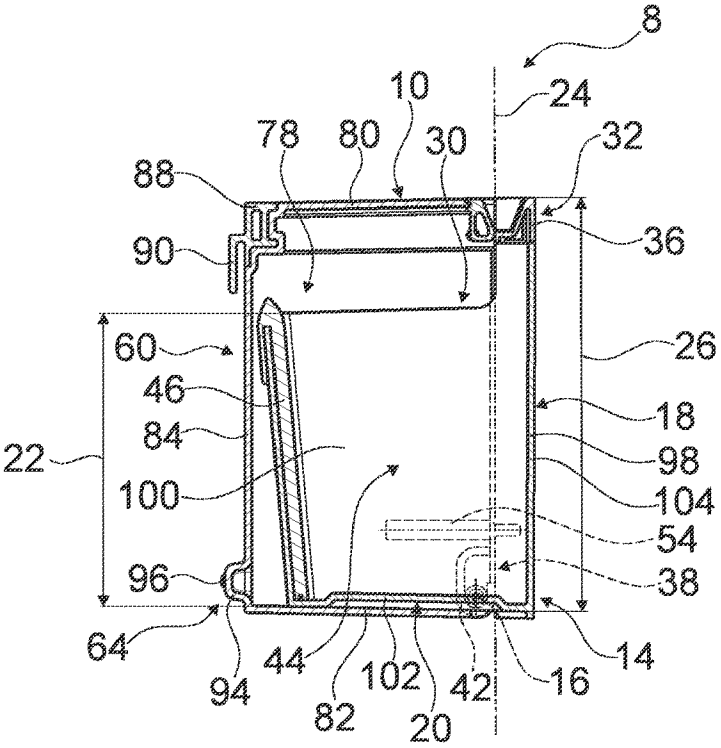

FIGS. 2A-2B and FIGS. 3A-2B show the door rack bin 8 in an opened state and a closed state respectively. The door rack bin 8 includes a door rack container 10. The door rack container 10 includes five walls 80, 82, 84, 86 in particular a top wall 80, a bottom wall 82, a back wall 84 and two lateral walls 86. The top wall 80 is at least substantially parallel to the bottom wall 82. The bottom wall 82, the back wall 84 and at least one of the lateral walls 86 are at least substantially perpendicular to one another. The walls 80, 82, 84, 86 are at least substantially translucent. The walls 80, 82, 84, 86 may in particular be made of plastic. The bottom wall 82, the back wall 84 and the lateral walls 86 may in particular be implemented integrally or in one piece. The door rack container 10 includes a frame 88. The frame 88 connects the lateral walls 86 and the back wall 84 to the top wall 80. The frame 88 connects the walls 80, 82, 84, 86 in a form-locking and/or force-locking manner. Alternatively or additionally the frame 88 may connect the walls 80, 82, 84, 86 through substance-to-substance bonding, preferably by adhesive bonding. The frame 88 is made of an opaque material. The frame 88 is made of metal, preferably aluminum. The door rack container 10 includes a receiving space 78. The five walls 80, 82, 84, 86 delimit the receiving space 78. The door rack container 10 has an access opening 12. The access opening 12 is situated opposite the back wall 84. The receiving space 78 is accessible by using the access opening 12. The access opening 12 has a main extension plane 24, which is oriented at least substantially parallel to a main extension plane 74 of the home appliance door 62.

The door rack bin 8 includes a pivot unit 14. The pivot unit 14 includes a container door 18. The container door 18 closes the access opening 12 in at least one operation state. The container door 18 includes a base body 98. The base body 98 is mostly at least substantially translucent. The base body 98 is made of an at least substantially translucent material, in particular plastic. The container door 18 has a door section 32. The door section 32 is flush with an upper section of the door rack container 10. The upper section of the door rack container 10 is defined by the frame 88. In particular when viewed in a direction at least substantially perpendicular to the main extension plane 24 of the access opening 12, the door section 32 and the upper portion of the door rack container 10 overlap with each other. The door section 32 forms a handle 36. The handle 36 has an at least substantially triangle-shaped cross-section. The door section 32, in particular the handle 36, is made of a different material than the base body 98 of the container door 18. The door section 32, in particular the handle 36, is made of the same material as the frame 88 and preferably of an opaque material, in particular metal and advantageously aluminum.

The pivot unit 14 includes a receptacle 20. The receptacle 20 is configured for storage of products, preferably medicines and/or victuals. In the closed state of the container door 18 the receptacle 20 is disposed at least mostly in the door rack container 10, in particular inside the receiving space 78. The receptacle 20 includes five walls 100, 102, 104, 106, namely in particular a back wall 100, a bottom wall 102, a front wall 104 and two lateral walls 106. At least the bottom wall 102, the back wall 100 and at least one of the lateral walls 106 are disposed at least substantially perpendicular to one another. The receptacle 20 includes a storage space 108. The storage space 108 is delimited by the walls 100, 102, 104, 106 of the receptacle 20. The receptacle 20 includes a storage opening 110 for storing products inside the storage space 108. In a closed state of the container door 18, a main extension plane of the storage opening 110 is in particular at least substantially perpendicular to the main extension plane 24 of the access opening 12 of the door rack container 10 and/or the main extension plane 74 of the home appliance door 62. The receptacle 20 is coupled to the container door 18. The container door 18 and the receptacle 20 of the pivot unit 14 are coupled in such a way that a movement of either one of the receptacle 20 and the container door 18 results in a movement of both the container door 18 and the receptacle 20. The receptacle 20 is coupled to the container door 18 through the front wall 104. The front wall 104 is implemented integrally with the container door 18, in particular the base body 98. Alternatively the receptacle 20 and the container door 18 are connected to each other in a form-locking and/or force-locking manner.

The receptacle 20 has an extension 22. The extension 22 of the receptacle 20 is at least substantially parallel to the main extension plane 24 of the access opening 12. The extension 22 of the receptacle 20 is at least substantially perpendicular to the pivot axis 16. The extension 22 is a main extension of the receptacle 20, in particular of the back wall 100 of the receptacle 20. The container door 18 has a corresponding extension 26, which corresponds to the extension 22 of the receptacle 20. The corresponding extension 26 of the receptacle container door 18 is at least substantially parallel to the main extension plane 24 of the access opening 12. The corresponding extension 26 of the container door 18 is at least substantially perpendicular to the pivot axis 16. The corresponding extension 26 is defined by a main extension of the container door 18. The extension 22 of the receptacle 20 is at least 5% shorter than the corresponding extension 26 of the container door 18 in a closed state of the container door 18.

The pivot unit 14 is pivotable around the pivot axis 16 with respect to the door rack container 10. The pivot unit 14 has an at least substantially L-shaped contour 30 when viewed in a direction of the pivot axis 16. The pivot axis 16 is horizontally disposed in an installation position. The pivot axis 16 is oriented at least substantially parallel to the horizontal plane 68 onto which the home appliance device is installed. The pivot axis 16 is at least substantially parallel to the main extension plane 74 of the home appliance door 62. The pivot axis 16 is disposed at a lower portion 28 of the door rack container 10, in particular in a vicinity of the bottom wall 82 of the door rack container 10 in an installation position. The home appliance device includes a bearing unit 38 for pivotably coupling the pivot unit 14 to the door rack container 10. The bearing unit 38 defines the pivot axis 16.

Figure 4C:
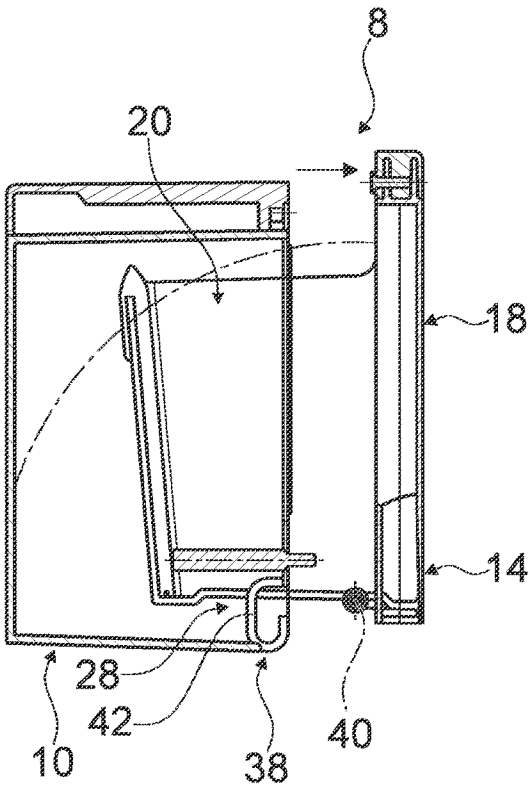
FIGS. 4A-4C are cross-sectional views showing a disassembly of a receptacle and a pivot unit of the door rack bin.
Figure 4B:
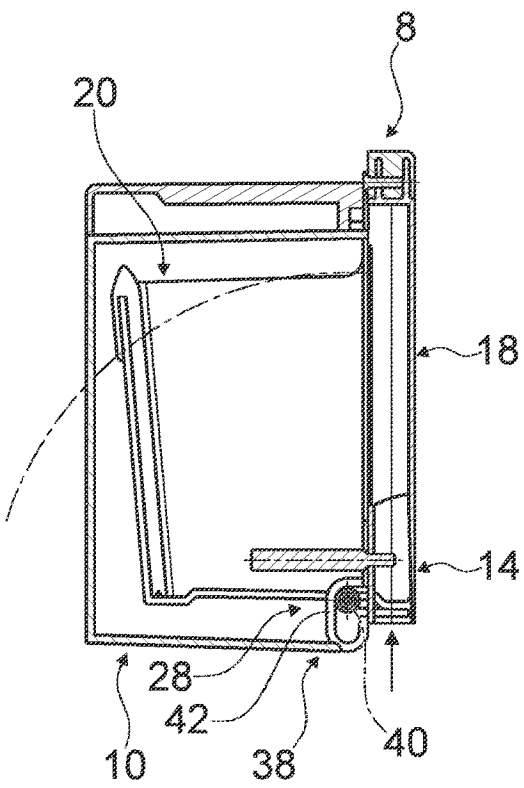
Figure 4A:
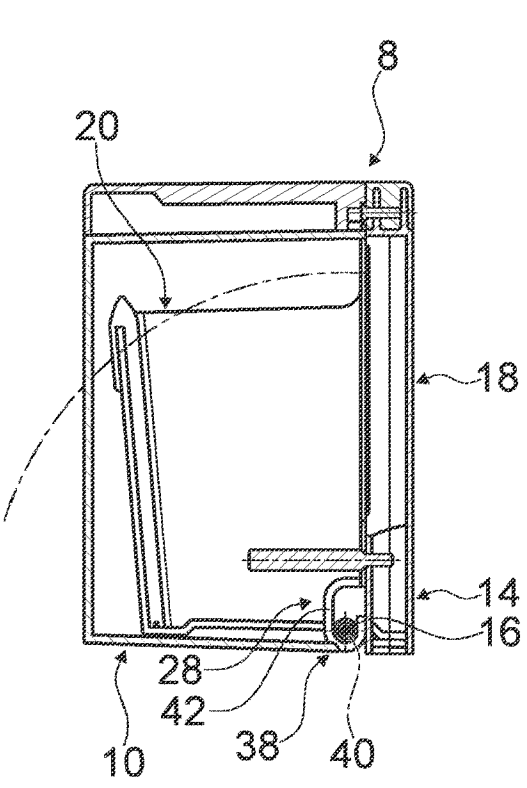

FIGS. 4A-4C show the bearing unit 38 in a cross-sectional view. The bearing unit 38 includes a first bearing element 40. The first bearing element 40 is coupled to the pivot unit 14. The first bearing element 40 is implemented integrally with the pivot unit 14. The first bearing element 40 is implemented as a rod and/or pin. The bearing unit 38 includes a second bearing element 42. The second bearing element 42 is coupled to the door rack container 10. The second bearing element 42 is implemented integrally with the door rack container 10. The second bearing element 42 is implemented as a slotted link. The first bearing element 40 and the second bearing element 42 are detachable from each other by moving the container door 18 with respect to the door rack container 10 in a direction at least substantially parallel to the main extension plane 24 of the access opening 12 and/or by moving the container door 18 with respect to the door rack container 10 in a direction at least substantially perpendicular to the main extension plane 24 of the access opening 12. The second bearing element 42 is at least substantially hook-shaped. The second bearing element 42 includes an L-shaped progression. The second bearing element 42 has a main extension which is at least substantially parallel to the main extension plane 24 of the access opening 12. The second bearing element 42 includes an opening, in particular for pulling the first bearing element 40 out of the second bearing element 42, which opens substantially in a direction of the main extension plane 24 of the access opening 12.

FIGS. 4A-4C show disassembly of the door rack bin 8 by using the bearing unit 38. The door rack bin 8 can be disassembled by moving the pivot unit 14 in a direction which is at least substantially parallel to the main extension plane 24 of the access opening 12. In particular, the door rack bin 8 can be consecutively disassembled by moving the pivot unit 14 in a direction which is at least substantially perpendicular to the main extension plane 24 of the access opening 12. An assembly of the door rack bin 8 takes place in the order opposite to the one described above.

Figure 5:
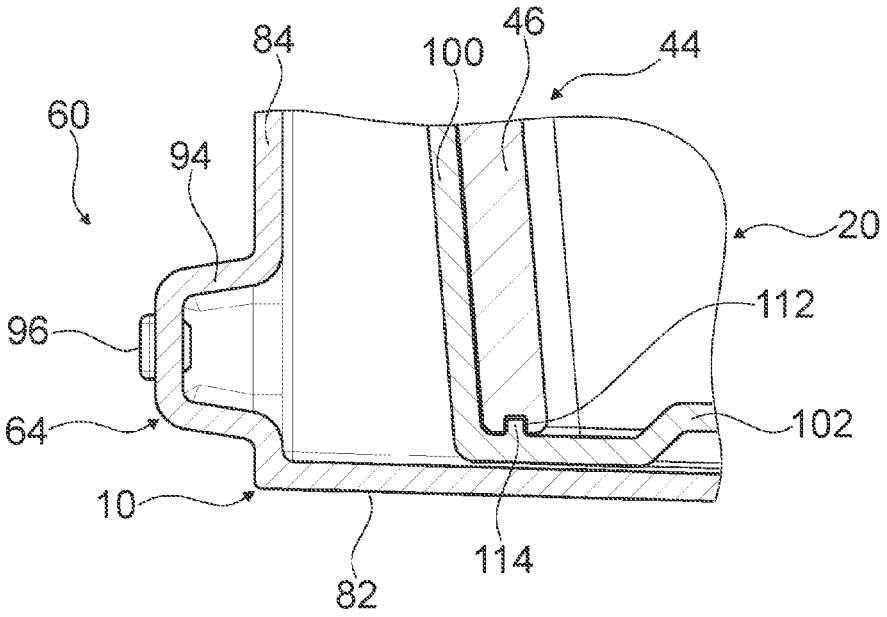
FIG. 5 is a fragmentary, enlarged, cross-sectional view showing a portion of the home appliance device, including a coupling unit.

The home appliance device further includes a coupling unit 60 (see FIGS. 3A-3B and 5). Through the use of the coupling unit 60, the door rack bin 8, in particular the door rack container 10, is releasably coupled to the home appliance door 62. The door rack container 10 is coupled to the inner surface 72 of the home appliance door 62. The door rack container 10 is disposed in such a way that a main extension plane 76 of the door rack container 10, in particular of the back wall 84 of the door rack container 10, is oriented at least substantially parallel to the main extension 74 of the home appliance door 62.

The coupling unit 60 is implemented at least partly integrally with the door rack container 10. The coupling unit 60 includes a mounting element 90. The mounting element 90 is connected to the door rack container 10, in particular to the frame 88. The mounting element 90 is implemented integrally with the door rack container 10, in particular the frame 88. Alternatively the mounting element 90 may be connected to and in particular implemented integrally with the back wall 84 of the door rack container 10. The mounting element 90 is implemented as a hook. The coupling unit 60 is at least partly implemented integrally with the home appliance door 62. The coupling unit 60 includes a corresponding mounting element 92. The corresponding mounting element 92 is connected to the home appliance door 62 (see FIG. 1). The corresponding mounting element 92 may be implemented integrally with the home appliance door 62. The corresponding mounting element 92 is at least substantially shaped corresponding to the mounting element 90. The mounting element 90 and the corresponding mounting element 92 are connected in a form-locking manner. Alternatively or additionally the mounting element 90 and the corresponding mounting element 92 may be connected in a force-locking manner and/or through substance-to-substance bonding, preferably by adhesive bonding. It is also conceivable that the door rack container 10 may be connected to the home appliance door 62 through substance-to-substance bonding, preferably by adhesive bonding, wherein preferably a coupling unit 60 may be redundant or may be dispensed with.

The coupling unit 60 includes an at least partly deformable coupling element 64. The coupling element 64 is shown in FIG. 5. The coupling element 64 supports the door rack container 10 with respect to the home appliance door 64. In an installation position the coupling element 64 is pressed against the inner surface 72 of the home appliance door 62 by the weight of the door rack bin 8. The coupling element 64 is at least partly implemented integrally with the door rack container 10, in particular the back wall 84 of the door rack container 10. The coupling element 64 includes a corbel 94. The corbel 94 is embodied by a protrusion of the door rack container 10, in particular of the back wall 84 of the door rack container 10. The coupling element 64 includes a deformable element 96. The deformable element 96 is implemented as a silicone plug.

Figure 6:
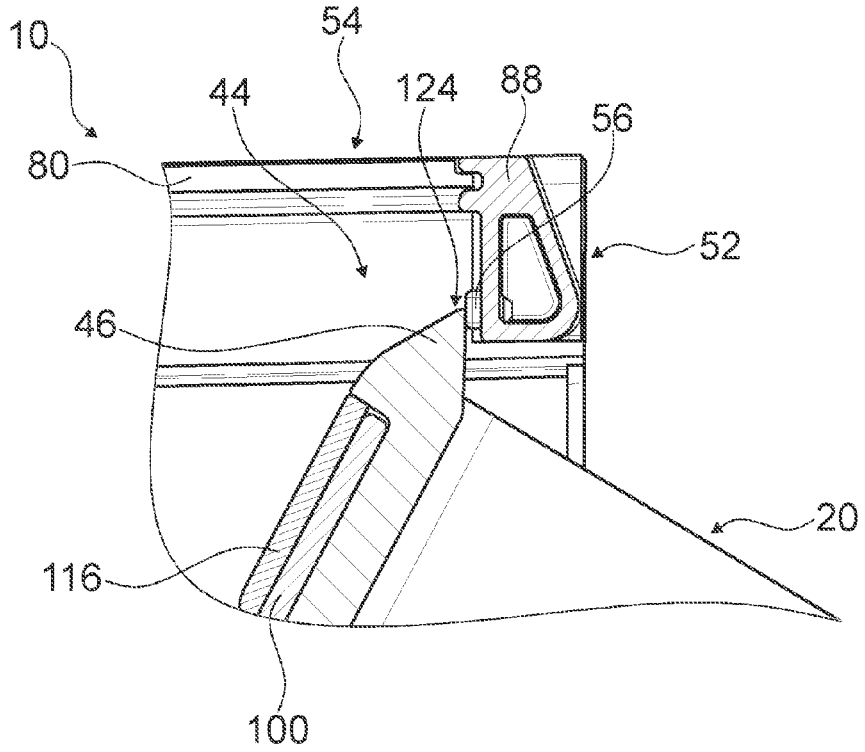
FIG. 6 is a fragmentary, enlarged, cross-sectional view showing a portion of the home appliance device, including a closing unit and a damping unit.
Figure 7:
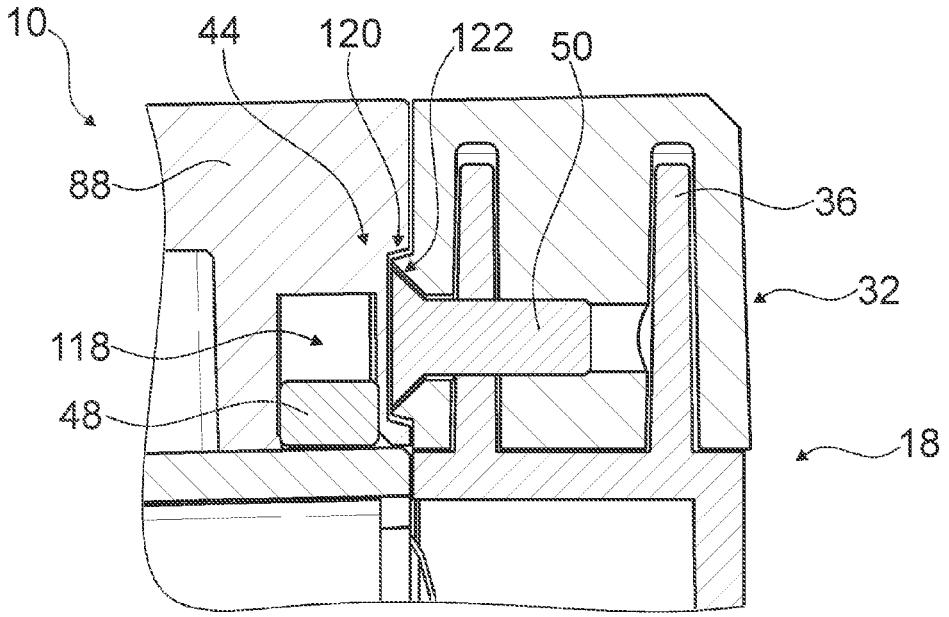
FIG. 7 is a fragmentary, enlarged, cross-sectional view showing a portion of the home appliance device, including a closing unit.

The home appliance device further includes a closure unit 44. FIGS. 5, 6 and 7 each show a portion of the closure unit 44 in a cross-sectional view. The closure unit 44 is configured for supporting a closing operation of the pivot unit 14. Further the closure unit 44 is configured for securing the pivot unit 14 in a closed state. The closure unit 44 includes a counterweight 46 (see FIG. 5). Through the use of the counterweight 46 a center of mass of the pivot unit 14 can be adjusted with respect to the pivot axis 16. The counterweight 46 is disposed opposite the container door 18. The counterweight 46 is coupled to the receptacle 20, in particular the back wall 100 of the receptacle 20. The counter weight 46 is connected to the receptacle in a form-locking and/or force-locking manner (see FIG. 5). The counterweight 46 includes a form-locking element 112, in particular at a lower end of the counterweight 46. The form-locking element 112 is embodied as a groove. The receptacle 20 includes a corresponding form-locking element 114. The corresponding form-locking element 114 is disposed at the bottom wall 102 of the receptacle 20. The corresponding form-locking element 114 is implemented as a tongue. The form-locking element 112 and the corresponding form-locking element 114 interconnect in a form-locking manner. The form-locking element 112 and the corresponding form-locking element 114 form a tongue-and-groove connection. Furthermore, the counterweight 46 is connected to the back wall 100 of the receptacle 20 in a force-locking and form-locking manner, in particular by a bolt connection and/or screw connection (see FIG. 6). The counterweight 46 is connected to the back wall 100 in the form of a sandwich composite. The receptacle 20 includes a back plate 116. The back plate 116 is used as a base for the bolt and/or screw connection. The back wall 100 of the receptacle 20 is disposed between the back plate 116 and the counter weight 46 when they are connected by the bolt and/or screw connection. The counterweight 46 is at least partly made of metal, e.g. zinc, aluminum, magnesium and/or copper and/or preferably of a metal alloy of those metals, advantageously Zamak. It is conceivable that the counterweight 46 may be made of any other material deemed advantageous by someone skilled in the art. The counterweight 46 extends over at least 50% of a surface area of the back wall 100. The weight of the counterweight 46 amounts to at least 40% of a weight of the pivot unit.

The closure unit 44 includes a first closing element 48 (see FIG. 7). The first closing element 48 is connected to the door rack container 10. The first closing element 48 is located in a vicinity of the access opening 12. The first closing element 48 is disposed inside the frame 88 of the door rack container 10. The frame 88 includes a cavity 118. The first closing element 48 is disposed inside the cavity 118. The closure unit 44 includes a corresponding second closing element 50. The second closing element 50 is connected to the container door 18, in particular at the door section 32. The second closing element 50 faces the access opening 12 in the closed state of the container door 18. The second closing element 50 is connected to the container door 18 in a force-locking and/or form-locking manner. The second closing element 50 is implemented as a screw. The second closing element 50 at least partly protrudes out of a surface of the container door 18 and forms a protrusion 122. The door rack container 10, in particular the frame 88, includes a recess 120 which corresponds to the protrusion 122 of the second closing element 50. The recess 120 is disposed in a vicinity of the first closing element 48. In a closed state of the container door 18, the recess 120 and the protrusion 122 create a form-locking connection. The first closing element 48 and the second closing element 50 interact with one another for supporting a closing operation of the container door 18. The first closing element 48 and the second closing element 50 interact with one another for securing the container door 18 in the closed state. The first closing element 48 and the second closing element 50 are at least partly made of a magnetic material, in particular a ferromagnetic material. The second closing element 50 and the first closing element 48 are, regardless of an operating state, always spaced apart from each other and preferably do not touch.

Figure 8:
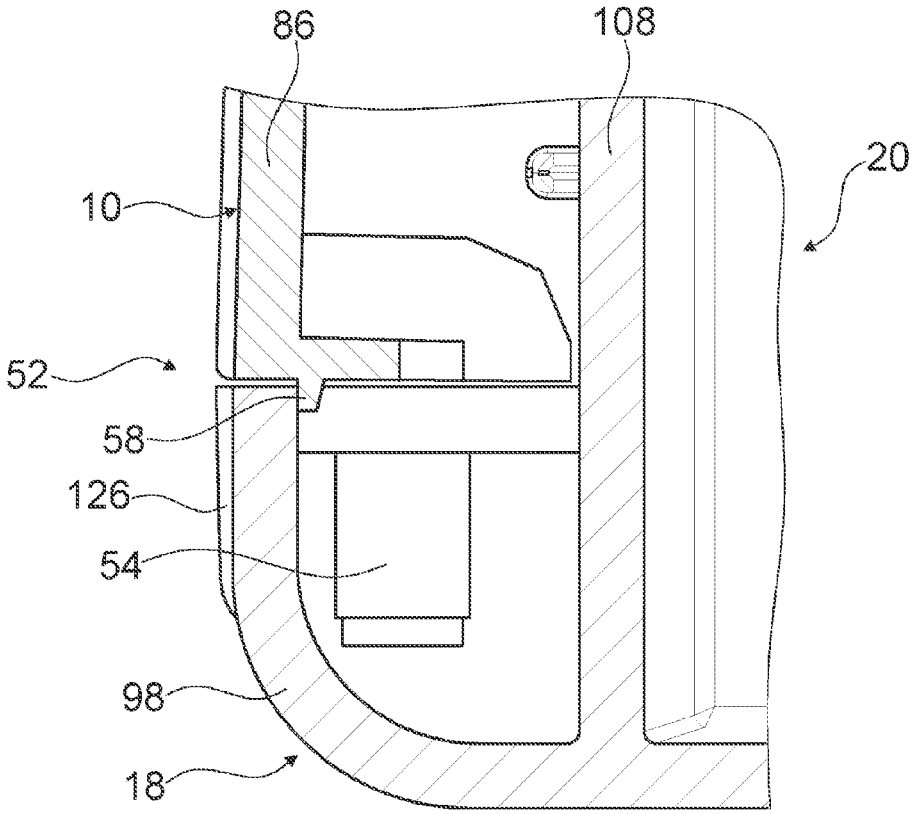
FIG. 8 is a fragmentary, enlarged, cross-sectional view showing a portion of the home appliance device, including a damping unit and a guiding element.

The home appliance device further includes a damping unit 52. FIGS. 6 and 8 each show a portion of the damping unit 52 in a cross-sectional view. During an opening and/or closing operation of the container door 18 the damping unit 52 damps a pivot movement of the pivot unit 14. The damping unit 52 includes a damping element 54 (see FIG. 8). During a closing operation of the container door 18 the damping element 54 damps a pivot movement of the container door 18. The damping element 54 is connected to the door rack container 10. The damping element 54 is located at least at one of the lateral walls 86 of the door rack container 10. The damping element 54 is at least partly deformable. In the present case the damping element 54 is implemented as an elastic piston. The damping element 54 may in particular be made at least partly of an elastic material or a spring.

The damping unit 52 includes a further damping element 56 (see FIG. 6). During an opening operation of the container door 18 the further damping element 56 damps a pivot movement of the receptacle 20. The further damping element 56 is connected to the frame 88, in particular to a side of the frame 88 which faces the inside of the door rack container 10. The further damping element 56 is in particular embodied as a silicone plug. The home appliance device includes a stopping element 124. The stopping element 124 strikes against the further damping element 56 when the container door 18 is opened. The stopping element 124 has an at least substantially triangular cross-section. The stopping element 124 is implemented integrally with the counterweight 46.

The door rack container 10 includes a guiding element 58 (see FIG. 8). The guiding element 58 centers the container door 18 with respect to the access opening 12. The guiding element 58 is implemented integrally with the door rack container 10, particularly the lateral wall 86 of the door rack container 10. The guiding element 58 is implemented as a ledge. A main extension of the guiding element 58 runs at least substantially parallel to the main extension plane 24 of the access opening 12. The container door 18 includes a corresponding guiding element 126. The corresponding guiding element 126 is embodied by a curved portion of the base body 98 of the container door 18. In a closed state of the container door, the guiding element 58 and the corresponding guiding element 126 align and close the door rack container 10 preferably airtightly.

The invention claimed is:

1. A home appliance device or home appliance chiller device, comprising:

a door rack container having an access opening defining a main extension plane;

a pivot unit being pivotably coupled to said door rack container about a pivot axis, said pivot unit including a container door for closing said access opening and a receptacle coupled to said container door for storing products, said container door having an extension;

said receptacle having an extension being at least substantially parallel to said main extension plane and at least substantially perpendicular to said pivot axis;

said extension of said receptacle being at least 5% shorter than said extension of said container door in a closed state of said container door;

a bearing unit configured to pivotably couple said pivot unit to said door rack container;

said bearing unit including a first bearing element coupled to said pivot unit and a second bearing element coupled to said door rack container;

said second bearing element being at least substantially hook-shaped and including an L-shaped progression and an opening, said opening being open substantially in a direction of said main extension plane of said access opening, and said second bearing element having a main extension being at least substantially parallel to said main extension plane of said access opening; and said first bearing element and said second bearing element being detachable from each other by moving said container door relative to said door rack container in a direction at least substantially parallel to said main extension plane of said access opening for pulling said first bearing element out of said second bearing element.

2. The home appliance device according to claim 1, wherein said pivot axis is horizontally disposed in an installation position.

3. The home appliance device according to claim 1, wherein said door rack container has a lower portion, and said pivot axis is disposed at said lower portion of said door rack container in an installation position.

4. The home appliance device according to claim 1, wherein said pivot unit has an at least substantially L-shaped contour along a direction of said pivot axis.

5. The home appliance device according to claim 1, wherein said door rack container has an upper portion, said container door has a door section being at least substantially flush with said upper portion of said door rack container, and said door section forms a handle.

6. The home appliance device according to claim 1, wherein said receptacle is disposed at least mostly inside said door rack container in said closed state of said container door.

7. The home appliance device according to claim 1, which further comprises a closure unit configured for at least one of supporting a closing operation of said pivot unit or securing said pivot unit in a closed state.

8. The home appliance device according to claim 7, wherein said closure unit includes a counterweight being coupled to said receptacle for adjusting a center of mass of said pivot unit relative to said pivot axis.

9. The home appliance device according to claim 8, wherein said counterweight is disposed opposite to said container door.

10. The home appliance device according to claim 7, wherein said closure unit includes a first closing element connected to said door rack container and a corresponding second closing element connected to said container door, said first and second closing elements interacting with one another for at least one of supporting a closing operation of said container door or securing said container door in said closed state.

11. The home appliance device according to claim 10, wherein said first closing element and said second closing element are at least partly made of a magnetic material.

12. The home appliance device according to claim 1, which further comprises a damping unit for damping a pivot movement of said pivot unit during at least one of an opening or closing operation of said container door.

13. The home appliance device according to claim 12, wherein said damping unit includes a damping element for damping a pivot movement of said container door during said closing operation of said container door.

14. The home appliance device according to claim 12, wherein said damping unit includes a further damping element for damping a pivot movement of said receptacle during said opening operation of said container door.

15. The home appliance device according to claim 1, wherein said pivot unit is at least partly translucent.

16. The home appliance device according to claim 1, wherein said door rack container includes a guiding element for centering said container door relative to said access opening.

17. The home appliance device according to claim 1, which further comprises a coupling unit configured for coupling said door rack container to a home appliance door, said coupling unit including an at least partly deformable coupling element supporting said door rack container relative to the home appliance door.

18. A home appliance or home chiller appliance, comprising a home appliance device according to claim 1.

* * * * *